US005166457A

United States Patent [19]

Lorenzetti

[11] Patent Number: 5,166,457

[45] Date of Patent: Nov. 24, 1992

[54] AMMUNITION MAGAZINE FOR PAINT BALL GUN

[76] Inventor: James A. Lorenzetti, 2849 Summit Rd., Copley, Ohio 44321

[21] Appl. No.: 823,855

[22] Filed: Jan. 22, 1992

[51] Int. Cl.[5] ..... F41A 9/64

[52] U.S. Cl. ..... 42/49.01; 124/49

[58] Field of Search ..... 42/6, 11, 17, 18, 21, 42/22, 24, 29, 33, 35, 37, 39, 49.01, 50, 60; 89/13.1, 33.1, 34; 124/41.1, 45, 49, 50; 221/24, 197, 287

[56] References Cited

U.S. PATENT DOCUMENTS

| | | | |
|---|---|---|---|
| 79,841 | 8/1905 | Wiesman | 124/49 |
| 383,350 | 4/1863 | Whitcomb | 89/13.1 |
| 3,285,236 | 11/1966 | Shafer | 124/41.1 |
| 3,680,863 | 8/1972 | Wallace et al. | 124/50 |
| 4,741,537 | 5/1988 | Adam | 124/50 |
| 4,819,609 | 4/1989 | Tippmann | 124/72 |
| 4,936,282 | 6/1990 | Dobbins | 124/74 |
| 4,977,676 | 12/1990 | Toupin | 33/254 |
| 5,001,880 | 3/1991 | Smith | 53/453 |
| 5,018,458 | 5/1991 | Smith | 102/513 |
| 5,097,816 | 3/1992 | Miller | 124/49 |

*Primary Examiner*—Stephen C. Bentley

*Attorney, Agent, or Firm*—Oldham, Oldham & Wilson Co.

[57] ABSTRACT

A magazine for gravity feed of frangible, paint-containing projectiles into a gas operated gun comprises a generally closed hollow container with a smooth inner surface, a filling port positioned on its upper portion and an outlet port positioned on a lower most portion. A transfer tube is attached externally to the outlet port to communicate the outlet port to a feed port on the gun. A channel is formed along the mixer surface so that the channel will direct projectiles along its length by gravity to its terminus at the outlet port. A raised portion of the inner surface around a portion of the circumference of the outlet port effectively forms a dam precluding flow of projectiles into the outlet port from the portion of the circumference so blocked.

9 Claims, 2 Drawing Sheets

AMMUNITION MAGAZINE FOR PAINT BALL GUN

The present invention relates to an ammunition magazine for providing, by gravity feed, a plurality of generally spherical liquid- filled frangible projectiles into the firing mechanism of a gun, particularly a gas-operated gun. More particularly, the present invention relates to such an ammunition magazine having a channel formed on the lower side thereof for queuing up a plurality of the spherical projectiles at the entrance of a vertical feed tube communicating the magazine to the gun. Even more particularly, the invention relates to an ammunition magazine further having a dam formed around a significant portion of the entrance to the vertical tube, thereby restricting entrance to the tube other than through the channel.

BACKGROUND OF THE ART

In recent years a sport has developed in the United States that is gaining popularity throughout the world. Known by various names, but referred to in this application as "paintball," the sport generally relates to groups of participants or players formed into two or more sides to engage in mock combat. Each player is armed with a gun, generally a gas-powered gun, capable of firing a generally spherical liquid-filled projectile containing a dye or paint. One such gun used is generally described in U.S. Pat. No. 4,936,282, issued to Dobbins, et al, on Jun. 26, 1990, and another type of gun is described in U.S. Pat. No. 4,819,609, issued to Tippmann on Apr. 11, 1989. Typically the guns exhibit low muzzle velocity and have a relatively short range. The projectiles are designed so that the polymeric coating or shell thereof will rupture on impact, thereby releasing the liquid filling. A method of producing the frangible projectiles is described in U.S. Pat. No. 5,001,880 issued to Smith on Mar. 26, 1991. In this manner, the combatants are able to strike an opponent and indicate injury or death, without actually causing physical harm to the opponent. Generally, the projectiles are known in the sport as "paintballs" and the guns that are used as generally known as "paint ball guns". Paintball guns come in may varieties including hand guns and rifles.

Other uses for the gas-operated guns and the frangible paintballs exist in the field of wildlife conservation and animal management, where the guns are generally referred to as "marking guns" and the projectiles are used to assist in counting and in tracking wild animals.

Paintball guns operate by dispensing individual paintballs by gravity feed into the firing chamber of the paintball gun. This dispensing is generally accomplished through a circular aperture in the top of the paintball gun and a vertically-oriented tube is usually used to queue up a plurality of paintballs between the ammunition magazine and the gun itself.

A common problem encountered with paintball guns involves bridging of the balls within the ammunition magazine at or near the point of entrance into the vertical feed tube communicating the magazine with the gun. The bridging problem results in failure of the balls to provide a continuous que and therefore in failure of the magazine to provide a continuous feed supply of projectiles to the gun.

SUMMARY OF THE INVENTION

It is, therefore, a first object of the invention to provide an ammunition magazine for a gun wherein the gravity feed through a bottom tube will not be disrupted by bridging of the projectiles in the ammunition magazine.

This and further objects of the invention are achieved by an ammunition magazine for dispensing uniformly-sized spherical projectiles by gravity into a gun adapted to shoot the projectiles, the ammunition magazine comprising a generally closed hollow container having a smooth inner surface, with a filling port positioned on an upper portion of the container and an outlet port positioned on the lowermost portion. A transfer tube is attached externally to the magazine at the outlet port. The transfer tube communicates the outlet port to a feed port on the gun. The magazine also features a means for minimizing the bridging of the spherical projectiles, this means being disposed on the lower portion of the container's inner surface. In one particular embodiment, the means for minimizing bridging comprises a channel originating along the inner surface and terminating at the outlet port, especially a channel that has a width slightly larger than the width of the spherical projectiles. In such an embodiment, the channel's depth increases smoothly from the origin of the channel to the outlet port and has a "U" shape cross section.

In another embodiment, the inner surface surrounding the outlet port is raised around a sufficient portion of the circumference of the outlet port to effectively act as a dam precluding entry of spherical projectiles into the outlet port from the portion of the circumference effectively dammed. If a channel is used, it is preferred to raise the inner surface surrounding the outlet port around a portion of the circumference of the outlet port opposite the terminus of the channel, so that entry to the outlet port is limited to the circumference thereof connected to the terminus of the channel.

In any of these embodiments, the preferred ammunition magazine effectively provides a continuous queue of the spherical projectiles along the length of the transfer tube and into the lower portion of the inner surface along the channel.

BRIEF DESCRIPTION OF THE DRAWINGS

The invention will be better understood when reference is made to the following drawings, wherein.

DETAILED DESCRIPTION OF THE DRAWINGS

Figure 1:
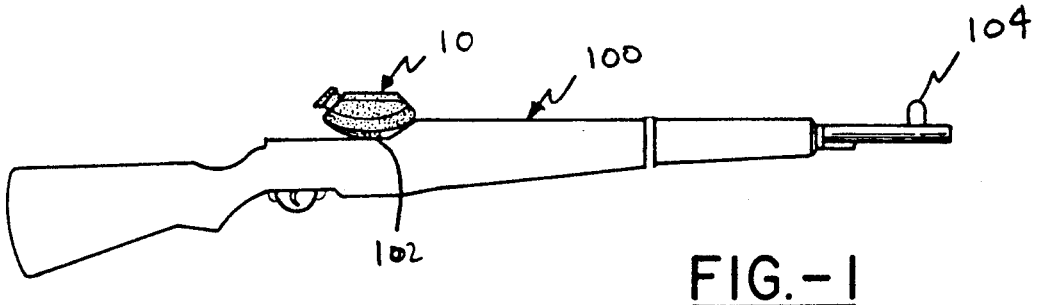
FIG. 1 shows in side elevational view the novel ammunition magazine of the present invention as installed atop a gun of the prior art.

FIG. 1 shows a novel ammunition magazine 10 for providing a continuous feed of projectiles into a vertical feed tube communicating the magazine and the firing chamber of gun 100. The gun 100 is preferably a gas-powered gun of the type disclosed in U.S. Pat. No. 4,936,282, U.S. Pat. No. 4,819,609, or other known types of guns used for expelling a relatively low velocity frangible projectile. As illustrated in FIG. 1, the ammunition magazine 10 is positioned atop gun 100 at the location equivalent to the magazine shown as feature numeral 14 in U.S. Pat. No. 4,936,282, FIG. 1.

Figure 2:
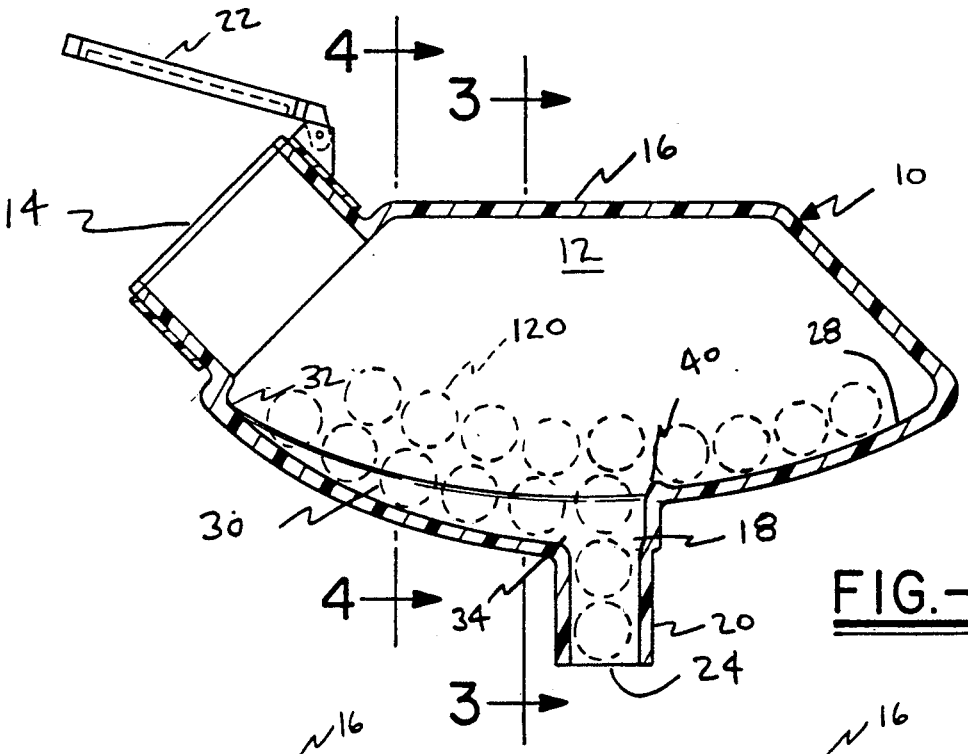
FIG. 2 shows a cross-sectional elevation view of the novel ammunition magazine taken along a longitudinal axis of symmetry.

Referring now to FIG. 2, which shows the ammunition magazine 10 of the present invention in a cross-sectional cut taken along the longitudinal axis of the magazine, the ammunition magazine 10 comprises a generally closed chamber 12 having a first opening 14 situated on an upper surface 16 of the magazine 10 and a second opening is situated at the lowermost portion of the chamber 12. The first opening 14 is intended for inserting a plurality of projectiles 120 into the chamber so that this opening 14 will generally have a diameter at least twice the diameter of projectile 120 and preferably in the range of 3 to 5 projectile diameters. The second opening 18 is the point of connection of an externally-connected vertical feed tube 20 with the chamber 12. Since the vertical feed tube 20 is used to provide the queue of projectiles 120 to the firing chamber of the gun 100, it will typically have an internal diameter slightly larger than the projectile diameter but it will not exceed the projectile diameter by more than 25% or so. If the diameter of feed tube 20 is too large, bridging of the projectile queue can occur in the feed tube itself.

The exact positioning of the first opening 14 in the ammunition magazine 10 may be anywhere around the periphery of the magazine, but it is preferred to place the first opening 14 on the upper portion 16, so that projectiles 120 already loaded into the magazine will not spill out when the opening 14 is used for inserting more projectiles. Typically this first opening 14 is fitted with a spring-loaded, frictionally retained cap 22 so that the chamber 12 is essentially closed when the chamber is not actually being filled. Neither the second opening 18 nor opening 24 from the feed tube 20 into the firing chamber of the gun 100 would typically have a covering or a lid on them when the ammunition magazine 10 is attached to gun 100, but a lid may be used to cover opening 24 when it is not attached.

The ammunition magazine 10 that would commonly be used in the art would have a chamber 12 sized so that a significant number of projectiles 120, preferably in excess of 100, could be placed inside the chamber 12. The exact internal and external shape of the magazine 10 is not particularly relevant to its function, provided that the internal bottom surface 28 of the magazine 10 is sloped gently downward toward the second opening 18 so that gravity flow of projectiles 120 will occur and so that projectiles 120 will not get isolated in corners. For aesthetic and functional purposes, including the balancing of the magazine 10 atop the gun, it is common to have the chamber 12 somewhat oblong along the axis of the barrel of the gun, that is, the longitudinal axis of magazine 10 along which FIG. 2 is taken, so that the center of gravity of the magazine 10 is clearly positioned atop the gun barrel and preferably atop the feed hole 18 in the lower surface 28 of the magazine. Although it is clearly preferred that the vertically oriented tube 20 that communicates the magazine 10 to the firing chamber of the gun be attached tangentially to both the magazine 10 and the gun 100, this also is not necessary and it is may be desirable in some applications to have the feed tube 20 oriented at an angle between the ammunition magazine 10 and the gun 100.

Figure 3:
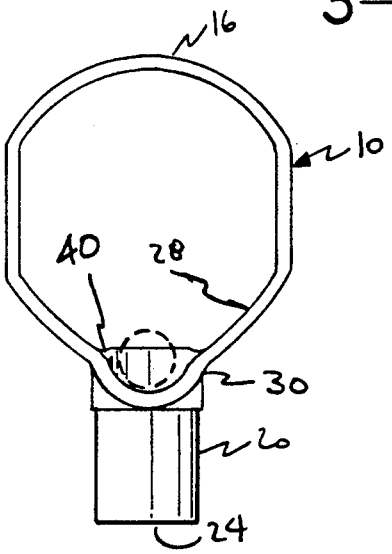
FIG. 3 shows a cross-sectional elevational view taken along Line 3—3 of FIG. 2 and disclosing features of the novel aspects of the ammunition magazine.
Figure 4:
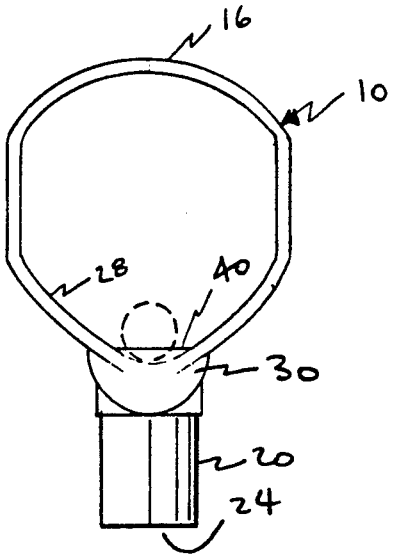
FIG. 4 shows a further cross-sectional elevational view taken along Line 4—4 in FIG. 2.

Having these general features of the magazine 10 thus described and understood, attention may be directed to the novel aspects of the present invention. When spherical particles 120 of substantially the same diameter are in close proximity and the particles are being withdrawn by gravity feed off of the bottom of the pile, certain orientations of the particles 120 may result in a phenomenon known as "bridging". In this case, particles at the lowermost lever are prevented from free-flow at the bottom opening 18 by the contact that the particle has with adjacent particles. In the bottom of a curved basin such as the bottom of the ammunition magazine 18 leading into a narrow feed tube 20 of diameter only slightly larger than the diameter of the projectiles 120, the bridging effect is often encountered. The object of the present invention is to provide a restricted access to the bottom opening 18 of the magazine 10 into the feed tube 20, so that projectile particles may enter the opening 18 and the feed tube 20 only from a relatively narrow radial portion of the circumference of the opening 18. Two specific means are used for achieving this feeding of the particles 120 into the feed tube 20. The first means is the formation of a flange or channel 30 in the interior lower surface 28 of the magazine 10 so that a queue of projectile particles 120 is formed along the channel 30 directly feeding into the feed tube 20 through the second opening 18. Since the channel 30 effectively has an "opening" with the interior chamber 12 all along its length, the difficulties presented by bridging at the second opening 18 are largely eliminated. In a particularly preferred embodiment of this channel or flange 30, the depth of this channel 30 gradually increases from the point of origin 32 to the terminus 34 thereof at the second opening 18, at which point the depth of the channel 30 may be about equal to the diameter of the projectile particle 120. The interior surface of the channel or flange 30 is preferably arcuate with a radius of curvature which will easily accommodate the curvature of the spherical particles 120, allowing a queue of particles 120 to form up and to roll within the channel 30. The channel 30 illustrated in the embodiment shown is a straight channel from the origin 32 to the terminus 34 at the second opening 18 although it is possible, and maybe desirable, in some circumstances, to form a channel 30 that will spiral from an outside portion of the magazine's inner surface 28 to the second opening 18. If a straight channel 30 is used, the preferred position is along the longitudinal axis of the magazine 10. This positioning, as well as the generally increasing depth, are clearly illustrated in FIGS. 2–4. The preferred channel 30 will have a "U" shaped cross-section transverse to its length.

Figure 5:
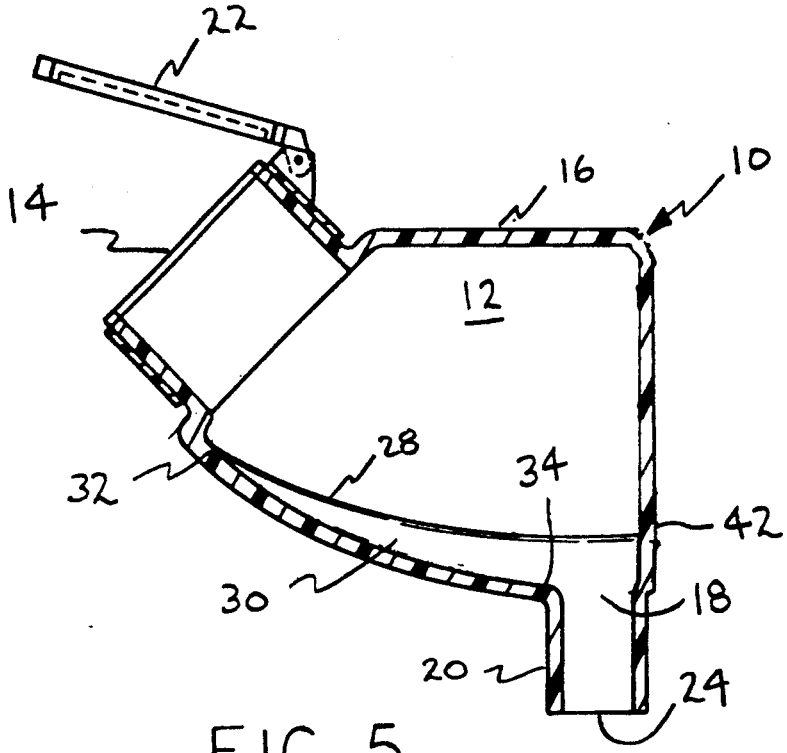
FIG. 5 shows a second embodiment of the magazine in cross-sectional elevational view along a longitudinal axis of symmetry.

The second means for preventing bridging in the ammunition magazine 10 is a dam 40 formed by raising the interior surface 28 of the magazine 10 around a portion of the second opening 18, thereby precluding the entry of particles 120 into the second opening from that radial portion of the magazine having the dam 40. When the dam 40 is used in conjunction with the channel 30 described above, the dam 40 should be centered on a point diametrically opposed to the connection of the channel 30 with the second opening 18. There are at least two methods of preparing such a dam 40. The first method, and clearly the preferred method, since it allows the second opening 18 to be centrally located on the bottom surface 28, is to mold the magazine 10 such that a dam 40 is formed around at least half of the second opening 18, thereby allowing entrance to the second opening 18 about no more than one half of its circumference. A second method of preparing such a dam 40 is to position the second opening 18 against a wall 42 of the magazine 10 at one end thereof, the wall 42 effectively forming a dam that forecloses entrance to the second opening 18 from a portion thereof. This second method is shown in FIG. 5, which will be recognized as the same view as FIG. 2, but with the dam 40 being replaced by wall 42.

This magazine 10 of the present invention may be formed from a variety of materials and in a variety of manners. The preferred method known by the inventor, however, is molding from a thermoplastic material such as polyethylene, polypropylene or the like in a known molding operation such as blow molding, injection molding or rotational molding.

The projectiles 120 described herein are known in the art and particularly described in several patents, including U.S. Pat. Nos. 4,819,609, 4,936,282 and 5,001,880, the last of which describes a particular method of producing such projectiles so that they are luminescent at night. Although it is preferred to use liquid-filled frangible projectiles, this invention is believed to be equally applicable to dispersing solid projectiles into a gun 100. The preferred projectiles 120 are about ¾" in diameter.

While FIG. 1 shows magazine 10 directly mounted on gun 100 at the loading hole 102 in gun 100, it would certainly be within the scope of the invention to extend the length of vertical tube 20 by either directly lengthening it or attaching it to an extension tube with a similar internal diameter. In this manner, the magazine 10 may be raised sufficiently above the sight 104 on gun 100 so as not to impede sighting of the weapon by the user.

While in accordance with the patent statutes, the best mode and preferred embodiment of the invention have been described, it is to be understood that the invention is not limited thereto, but rather is to be measured by the scope and spirit of the appended claims.

What is claimed is:

1. An ammunition magazine for dispensing uniformly-sized spherical projectiles by gravity into a gun adapted to shoot said projectiles, said ammunition magazine comprising:

a generally closed hollow container having a smooth inner surface, a filling port positioned on an upper portion thereof and an outlet port positioned on a lowermost portion thereof;

a straight thin-walled transfer tube adapted to hold a plurality of the projectiles attached externally to the magazine at the outlet port and extending essentially vertically downwardly, thus communicating said outlet port to a feed port on said gun and a channel originating along the inner surface and terminating at the outlet port, said channel extending gradually downwardly and having a depth at the outlet port greater than one half the diameter of the projectiles.

2. The ammunition magazine of claim 1 wherein the channel has a width slightly larger than the width of the spherical projectiles.

3. The ammunition magazine of claim 2 wherein the channel has a depth that increases smoothly from the origin of the channel to the outlet port.

4. The ammunition magazine of claim 1 wherein the channel has a "U" shape cross section.

5. The ammunition magazine of claim 1 wherein the channel is straight from its origin to its terminus.

6. The ammunition magazine of claim 5 wherein the channel lies along a longitudinal axis of the container.

7. The ammunition magazine of claim 1 wherein the inner surface surrounding the outlet port is raised an amount less than a radius of the projectiles around a portion of the circumference of said outlet port opposite the terminus of said channel, said raised inner surface covering a sufficient portion of the circumference to effectively act as a dam limiting entry into the outlet port to the circumference thereof connected to the terminus.

8. The ammunition magazine of claim 1 wherein a continuous queue of said spherical projectiles is effectively formed along the entire length of the transfer tube and into the lower portion of the inner surface along said channel.

9. An ammunition magazine for dispensing uniformly-sized spherical projectiles by gravity into a gun adapted to shoot said projectiles, said ammunition magazine comprising:

a generally closed hollow container having a smooth inner surface, a filling port positioned on an upper portion thereof and an outlet port positioned on a lowermost portion thereof;

a straight thin-walled transfer tube attached externally to the magazine at the outlet port and communicating said outlet port to a feed port on said gun; and a channel originating along the inner surface and terminating at the outlet port;

said inner surface surrounding a sufficient portion of the circumference of the outlet port being raised less than a radius of the projectiles opposite the terminus of the channel to effectively act as a dam limiting entry into the outlet port to the circumference thereof connected to the terminus.

* * * * *